United States Patent [19]

Klein

[11] Patent Number: 4,961,275

[45] Date of Patent: Oct. 9, 1990

[54] IDENTIFICATION BADGE

[76] Inventor: Rita R.. Klein, 634 E. Cunningham Dr., Palatine, Ill. 60067

[21] Appl. No.: 272,230

[22] Filed: Nov. 16, 1988

[51] Int. Cl.[5] ..... A44C 3/00

[52] U.S. Cl. ..... 40/1.5; 40/16

[58] Field of Search ..... 40/1.5, 1.6, 908, 620, 40/636, 640, 586, 329

[56] References Cited

U.S. PATENT DOCUMENTS

| | | | |
|---|---|---|---|
| 2,177,406 | 10/1939 | Hacker | 40/1.5 |
| 4,236,331 | 12/1980 | Mattson | 40/1.5 |
| 4,459,772 | 7/1984 | Kanzelberger | 40/1.5 |
| 4,621,441 | 11/1986 | Wagner et al. | 40/636 |
| 4,697,362 | 10/1987 | Wasserman | 40/636 |

*Primary Examiner*—Gene Mancene
*Assistant Examiner*—Cary E. Stone
*Attorney, Agent, or Firm*—Dressler, Goldsmith, Shore, Sutker & Milnamow, Ltd.

[57] ABSTRACT

An identification badge is provided to enable hospital personnel to be identified in a delivery room but not pose a danger of scratching neonatal infants. The badge contains a loop fabric layer and a hook fabric layer of a hook and loop fastener, one of said fabric layers bearing identification indicia and the other being attachable to the fabric of a wearer's outer garment through a penetrating fastener. A rigid support member, substantially smaller than either fabric layer is positioned between them and serves as an anchor for the penetrating fastener.

3 Claims, 1 Drawing Sheet

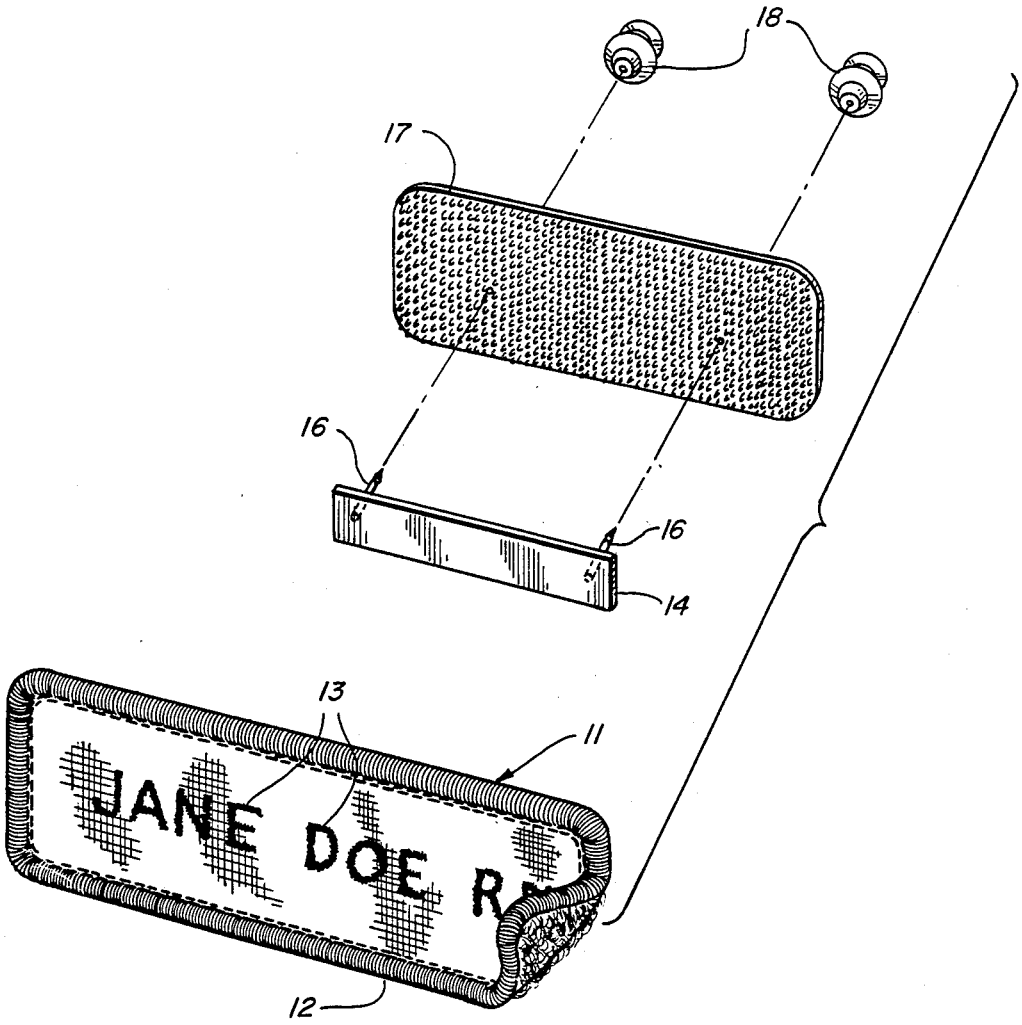
18
17
16
16
14
13
11
JANE DOE R
12

IDENTIFICATION BADGE

BACKGROUND OF THE INVENTION

In modern maternity hospitals, it is customary to maintain neonatal infants in a separate nursery room and to carry them to and from their mothers' rooms as needed for breast feeding or for being held. At times, neonatal infants are taken from their mothers when the mothers are in a drowsy or somnolent state. It is important for the peace of mind of the mothers that they know who it is who is taking their infants from them and to identify them as individuals rather than merely as anonymous staff members or nurses. Nevertheless, identification badges or tags are not worn, in many cases, by persons who care for neonatal infants because of the fear of scratching the infants, while they are being held or cared for, by the sharp and hard edges of the usual identification badges.

Satisfactory substitute badges have not been found; and nursery room staff persons have been performing their functions without badges, although it is recognized that this is less than optimum.

SUMMARY OF THE INVENTION

In accordance with this invention there is provided an identification badge for outerware comprising a separable fastener made up of a loop fabric layer and a hook fabric layer, attachable to each other on contact through multiple hook and loop engagement, one of said fabric layers being slightly smaller in length and width than the other, a rigid support member positioned between said loop fabric layer and said hook fabric layer and substantially smaller in length and width than either of them, a penetrating fastener integral with said rigid support member which passes through the smaller of said fabrics and has at least one pointed end for attachment through said sterile outerware, identification indicia on the outer surface of the larger of said fabric layers when said layers are engaged about said support member, said larger fabric layer being surrounded by an embroidered edge.

BRIEF DESCRIPTION

The single FIGURE is an exploded, perspective view of the identification badge of this invention with a corner of one element folded over to illustrate its opposite side thereof.

DETAILED DESCRIPTION OF THE INVENTION

In the FIGURE, fabric layer 11 is a generally rectangular piece of the loop fabric used in a fastener of the hook and loop type sold commercially under the trademark VELCRO, owned by Velcro Corporation, 681 5th Ave., New York, N.Y.

Hook and loop fasteners comprise two separable fabric sheets which have, at one surface, raised threads of synthetic material. In one of the fabric sheets, the raised threads are loops which have been cut at their outer extremities to form hooks while the other fabric sheets has loops which remain uncut. The former is called the "hook fabric layer" and the latter is called the "loop fabric layer."

When a surface containing hooks is placed into face-to-face contact with a surface containing loops, a plurality of hooks engage a plurality of loops to form a connection which is resistant to separation, except by peeling.

Typically, loop fabric layer 11 may measure about 4 by 1½ inches. The corners of fabric layer 11 are preferably rounded and the edges thereof are embroidered with closely spaced stitching 12 to make them soft and rounded.

On the outer face of fabric layer 11 there are indicia 13 to identify the wearer. The indicia are shown to be embroidered, but may be printed. As shown in the Figure, one corner of fabric layer 11 is turned up to illustrate the loop surface thereof.

Rigid support 14 serves to hold the identification badge flat against the outer garment of the wearer. It also provides anchoring for the penetrating fastener. It is preferably made of a thermosetting resin, such as a phenol-formaldehyde, or a urea-formaldehyde resin.

Pointed posts 16 are permanently attached to rigid support 14 and extend rearward to enable the posts to pierce, in order, hook fabric layer 17 and the outer garment of the wearer (not shown) and then to enter and be held by locking members 18.

The fastener combination of pointed posts and locking members is similar to that commonly used for such clothing ornaments as tie tacks.

When the identification badge of this invention is to be worn, the rigid support is centrally placed over the hook fabric layer with its pointed posts pointing toward the hooks; and the posts are pushed through the hook fabric layer to make an assembly of rigid support and the hook fabric layer. The assembly is then placed over a desired portion of an outer garment to be worn, such as a breast portion of a surgical gown, with pointed posts facing the fabric of the outer garment. The assembly is then pushed through the fabric of the outer garment; and the locking members are then placed over the pointed posts and locked into position. Thereafter, the loop fabric layer is placed over the hook fabric layer and pressed into attachment therewith.

In another embodiment, the hook and loop fabric layers may be reversed so that the loop fabric layer is the inward layer against the fabric of the outer garment and the hook fabric layer is the outward layer bearing the indicia.

In another embodiment, the pointed post and locking member fasteners may be replaced by another type of penetrating fastener, such as by a fastener of the safety pin type in which a spring biased pointed pin arm penetrates the outer garment of a wearer first from the outer surface inward and then from the inner surface outward. Finally, the tip end of the pin arm is locked into a rearwardly disposed hook which is affixed to the rigid member and is pushed through the hook fabric layer or through an aperture therein.

The invention has been described in connection with its preferred embodiments. It is to be understood that further modifications may now suggest themselves to those skilled in the art and it is intended to cover such modifications as fall within the scope of the appended claims.

I claim:

1. An identification badge for sterile outerware comprising a separable fastener made up of a loop fabric layer and a hook fabric layer, attachable to each other on contact through multiple hook and loop engagement, one of said fabric layers being slightly smaller in length and width than the other, a rigid support member positioned between said loop fabric layer and said hook fabric layer and substantially smaller in length and width than either of them, a penetrating fastener integral with said rigid support member which passes through the smaller of said fabrics and has at least one pointed end for attachment through said sterile outerware, identification indicia on the outer surface of the larger of said fabric layers when said layers are engaged about said support member, said larger fabric layer being surrounded by an embroidered edge.

2. The identification badge of claim 1 wherein said indicia and embroidered edge are on said loop fabric.

3. The identification badge of claim 1 wherein said penetrating fastener comprises two spaced apart pointed posts, each adapted to receive a separate locking member which fits over said post.

* * * * *